US011220277B2

(12) United States Patent
Wieser et al.

(10) Patent No.: US 11,220,277 B2
(45) Date of Patent: Jan. 11, 2022

(54) CABLE TRANSPORTATION SYSTEM

(71) Applicant: LEITNER S.P.A., Vipiteno (IT)

(72) Inventors: Hartmut Wieser, Racines (IT); Alexander Pechlaner, Sterzing (IT); Stefano Fontana, Pfitsch (IT)

(73) Assignee: LEITNER S.P.A., Vipiteno (IT)

( * ) Notice: Subject to any disclaimer, the term of this patent is extended or adjusted under 35 U.S.C. 154(b) by 324 days.

(21) Appl. No.: 16/525,048

(22) Filed: Jul. 29, 2019

(65) Prior Publication Data

US 2020/0039537 A1 Feb. 6, 2020

(30) Foreign Application Priority Data

Jul. 31, 2018 (IT) ..... 102018000007692

(51) Int. Cl.
*B61B 7/06* (2006.01)
*B61B 7/02* (2006.01)
*B61B 12/02* (2006.01)

(52) U.S. Cl.
CPC ..... *B61B 7/06* (2013.01); *B61B 7/02* (2013.01); *B61B 12/02* (2013.01)

(58) Field of Classification Search
CPC .... B61B 7/00; B61B 7/02; B61B 7/06; B61B 12/02
See application file for complete search history.

(56) References Cited

U.S. PATENT DOCUMENTS

2010/0154671 A1* 6/2010 Wieser ..... B61B 12/002 105/149.2
2013/0319280 A1* 12/2013 Wieser ..... B61B 12/02 104/112
2019/0375432 A1* 12/2019 Erharter ..... B61B 12/02
2020/0039537 A1* 2/2020 Wieser ..... B61B 7/02
(Continued)

FOREIGN PATENT DOCUMENTS

EP 0 397 270 11/1990
EP 1 498 335 1/2005
EP 2 933 219 10/2015
(Continued)

OTHER PUBLICATIONS

Italian Search Report for Italian Application No. IT 2018000007692 dated Apr. 5, 2019.

*Primary Examiner* — Jason C Smith
(74) *Attorney, Agent, or Firm* — Neal, Gerber & Eisenberg LLP

(57) ABSTRACT

A cable transportation system comprising: a first terminal station; a second terminal station; a plurality of transporting units moved between the terminal stations; at least one supporting cable for supporting the transporting units between the terminal stations; wherein the supporting cable comprises a first end housed inside the first terminal station and a second end housed inside the second terminal station; a first anchor device for anchoring the first end of the supporting cable inside the first terminal station; a second anchor device for anchoring the second end of the support-
(Continued)

ing cable inside the second terminal station; wherein the anchor devices are configured to selectively block the ends of the supporting cable inside the respective terminal stations and to enable a stepped sliding of the supporting cable between the terminal stations.

18 Claims, 5 Drawing Sheets

(56) References Cited

U.S. PATENT DOCUMENTS

| | | | | |
|---|---|---|---|---|
| 2020/0385029 | A1* | 12/2020 | Erharter | B61B 7/00 |
| 2021/0031811 | A1* | 2/2021 | Erharter | B61B 7/06 |

FOREIGN PATENT DOCUMENTS

| | | |
|---|---|---|
| EP | 3 309 034 | 4/2018 |
| FR | 2 935 945 | 3/2010 |
| WO | WO 2017/090065 | 6/2017 |

* cited by examiner

CABLE TRANSPORTATION SYSTEM

PRIORITY CLAIM

This application claims the benefit of and priority to Italian Patent Application No. 102018000007692, filed on Jul. 31, 2018, the entire contents of which are incorporated by reference herein.

TECHNICAL FIELD

The present disclosure relates to a cable transportation system. In particular, the present disclosure relates to a cable transportation system comprising at least one supporting cable for supporting, in a suspended manner, a plurality of transporting units that are moved along a path extending between two opposite terminal stations, usually referred to as the downstream station and the upstream station.

The technical field of the present disclosure is not limited to one particular type of cable transportation system. Indeed, the present disclosure may be used in bi-cable systems, comprising a supporting cable and a hauling cable, and in tri-cable systems comprising two supporting cables and one hauling cable. The terms bi-cable and tri-cable clearly refer to the number of cables present in a single ascending or descending line of the system. Furthermore, the present disclosure can be incorporated into so-called "reversible" systems, in which each transporting unit travels up and down along the same line of the system, and in systems in which the units are circulated and travel up and down along parallel lines of the system.

BACKGROUND

In cable transportation systems with one hauling cable and at least one supporting cable, the hauling cable is a closed-loop cable that is circulated in the system by motorized pulleys housed inside the upstream and downstream stations. The supporting cable, on the other hand, is an open cable (that is, not a loop) comprising an upstream end anchored inside the upstream station and a downstream end anchored inside the downstream station. In particular, inside the relative station, the end of the supporting cable is first wound around a drum, typically it is wound around the drum three times, and is then coupled to appropriate clamps that are capable of withstanding the residual pulling force in the cable. In one of the upstream or downstream stations, such as in the upstream station, the free end of the supporting cable is also wound around a spare drum. Thus, during the normal use of the system the supporting cables do not move forward along the system between the upstream and downstream stations.

Furthermore, in cable transportation systems, the supporting cable often has to be supported at intermediate points between the downstream and upstream stations. Sometimes the distance between two stations is too long for the supporting cable to be arranged in a single span. In other cases, the specific topography of the system route may call for variations in the slope of the supporting cable. In all of these cases, and in other cases not listed here, the cable transportation systems comprise one or more intermediate supports, each of which comprises a vertical supporting structure such as a pylon or tower, for example, provided at the top with a support for the cables, known in the sector as a "shoe". In particular, the shoe has an upper end configured to provide a seat to support the supporting cable and a series of rollers arranged beneath the upper end that cooperate with the hauling cable. In the case of tri-cable systems, the transporting unit comprises a cabin with a roof from which a supporting arm extends and is connected at the other end to a carriage supported by the supporting cables. Said carriage comprises at least one roller that rolls over the supporting cable and is provided with a groove suitable to at least partially house the supporting cable. When the carriage runs over the shoe, that is, the support arranged at the top of the pillars between the stations, the hauling cable, when present, is lifted off the rollers on the shoe and, as a consequence, exerts a downward pull on the carriage. In detail, this downward pull is produced by the hauling cable being lifted off the set of rollers on the shoe and is discharged by the carriage rollers onto the supporting cable. At the shoe, the supporting cable is free to slide a little in a longitudinal direction to compensate the variable load conditions and differences in temperature during the operation of the system. Such sliding movements stress the cable locally to a greater extent than the rest of the cable arranged outside the shoe.

To overcome this drawback and prevent excessive local damage to the supporting cable, the systems known in the prior art are serviced at regular intervals to translate or slide the supporting cable along the path. As a result of such translation, the portion of cable that was previously at the shoe, and thus subject to relatively greater stress, is now outside the shoe where there is no risk of any further compressive force being applied. At the same time a portion of cable that was not previously housed in the shoe, and thus not damaged, is now housed in the shoe until the next scheduled translation. At one end of the supporting cable a "new" portion of cable is unwound from the spare drum and fed into the path while at the opposite end a "used" portion of cable is gathered up in the station or directly eliminated before the system is re-started. Clearly, such regular sliding of the supporting cable extends the technical life of the cable.

The operations performed to slide the cable along thus involve at least partially freeing the ends anchored inside the terminal stations, sliding the cable along and re-anchoring the "new" ends inside the station. Besides being relatively dangerous, such operations are relatively extremely onerous and at present must be performed by specialised personnel and involve relatively long downtimes and the use of equipment that is not usually included in the system.

SUMMARY

The purpose of the present disclosure is to provide an alternative cable transportation system that overcomes certain of the problems of certain of the prior art. In particular, the purpose of the present disclosure is to provide a cable transportation system that enables a periodic relatively quick and relatively safe sliding of the supporting cables.

The present disclosure refers to a cable transportation system comprising:

- a first terminal station;
- a second terminal station;
- a plurality of transporting units moved between the terminal stations;
- at least one supporting cable configured to support the transporting units, in a suspended manner, between the terminal stations.

In particular, for the purposes of the present disclosure, the above-mentioned supporting cable is not of the closed-loop type that is circulated between the terminal stations, but comprises a first end housed inside the first terminal station and a second end housed inside the second terminal station. In this configuration, specific anchor devices act on such ends inside the relative stations to withstand the pull, that is the force, generated along the cable owing to the weight of the transporting units. In various embodiments, the system according to the present disclosure could be a bi-cable system (with one supporting cable and one hauling cable) or a tri-cable system (with two supporting cables and one hauling cable). It should be appreciated that mono-cable systems in which the single cable acts as both supporting cable and hauling cable are not included in the present disclosure because the cable moves continuously and does not have any free ends anchored inside the station.

Thus, the system according to the present disclosure comprises a first anchor device configured to anchor the first end of the supporting cable inside the first terminal station (that is, to a fixed structure of the first station) and a second anchor device configured to anchor the second end of the supporting cable inside the second terminal station (that is, to a fixed structure of the second station). Starting from this configuration, the anchor devices are configured to selectively block or anchor the ends of the supporting cable inside the respective terminal stations and to enable a stepped sliding of the supporting cable between the terminal stations.

Advantageously, the system is provided with suitable devices to achieve the regular sliding of the supporting cable and does not require the use of external equipment that has to be installed temporarily. As such, since it is the actual anchor devices that enable such sliding, the periodical operations performed to slide the cable along can be performed relatively quickly and relatively safely.

According to various embodiments of the disclosure, the first anchor device comprises a winding drum configured to wind the end of the supporting cable and at least one fixed clamp coupled to the supporting cable exiting the winding drum. The purpose of such clamp is to absorb the residual pull that is not discharged when the cable is wound onto the drum. In certain embodiments, the end of the cable beyond the clamp (on the opposite side with respect to the winding drum) is kept in the station wound on a spare drum. This excess part of the cable will be used as a supply of sections of "new" cable to be introduced along the path of the system during the regular sliding of said cable. In certain embodiments, the first anchor device may further comprise at least one mobile clamp coupled to the end of the cable beyond the fixed clamp (on the opposite side with respect to the winding drum). Said first anchor device may be housed inside either the upstream terminal station or downstream terminal station. In both cases, the second anchor device is housed inside the other station as described below.

According to various embodiments of the disclosure, the second anchor device comprises a molten head in which the second end of the supporting cable is embedded. The use of molten head technology for cables is known in the prior art and therefore requires no further details. According to the disclosure the molten head is housed in a guiding device configured to guide the molten head along a sliding direction in the station. In certain embodiments, the molten head slides along the guide in a step-by-step manner. For that purpose, there is a blocking pin configured to axially couple with respective holes provided in the molten head and along the guiding device so that the molten head can be anchored by the blocking pin to the guiding device in a plurality of positions. The sliding direction of the molten head is such that at each sliding step a "used" portion of the supporting cable enters the station drawing out part of the supply of "new" cable housed inside the opposite station. In certain embodiments, the second anchor device comprises an actuator device, for example a hydraulic or mechanical actuator, configured to move the molten head along the guiding device. In certain embodiments, the second anchor device may comprise at least one auxiliary clamp upstream of the guiding device.

In certain embodiments of the case of tri-cable systems, both ends of the two supporting cables are joined to one another. For example, there may be a specific structure to which the molten heads of the two supporting cables are anchored. In that way, both supporting cables are made to slide simultaneously.

Additional features are described in, and will be apparent from the following Detailed Description and the figures.

BRIEF DESCRIPTION OF THE DRAWINGS

Further characteristics and advantages of the present disclosure will become clear from the following description of a non-limiting embodiment thereof, with reference to the Figures in the accompanying drawings, in which.

DETAILED DESCRIPTION

The present disclosure refers to a cable transportation system.

Figure 1:
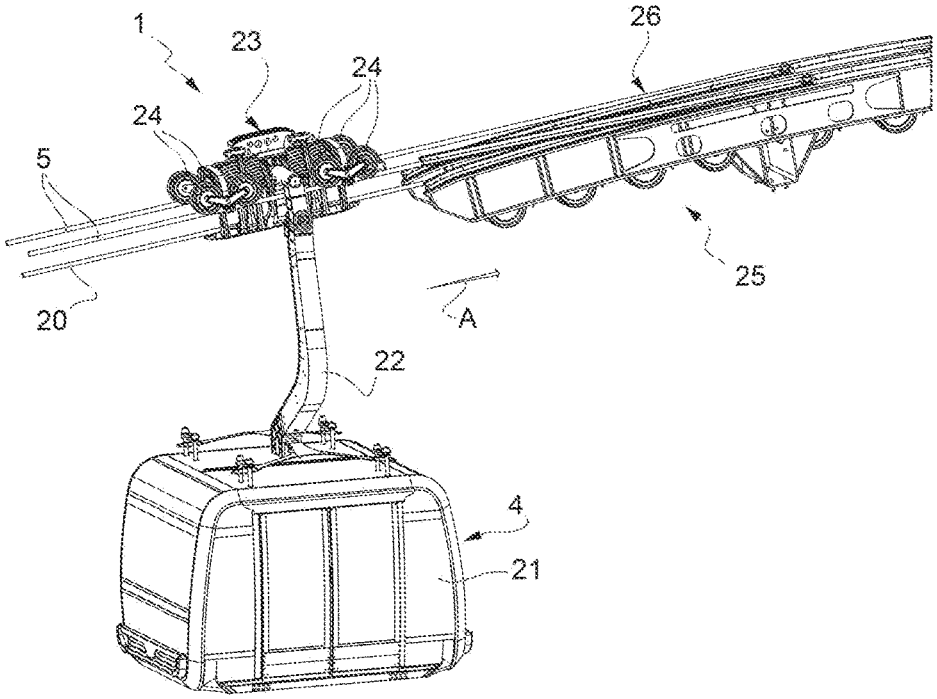
FIG. 1 is a schematic view of an intermediate portion between the upstream and downstream stations of a type of cable system into which the present disclosure can be incorporated.

Referring now to the example embodiments of the present disclosure illustrated in FIGS. 1 to 8, and specifically referring to FIG. 1 that shows a schematic view of an intermediate portion of a type of cable system into which the present disclosure can be incorporated. In the example that is illustrated, the cable transportation system of FIG. 1 comprises two supporting cables 5 and a hauling cable 20, respectively for supporting and hauling a plurality of transporting units 4. In FIG. 1, the transporting unit 4 comprises a cabin 21 from the roof of which extends a suspension arm 22 anchored at the top to a trolley 23. The trolley 23 comprises rollers 24 that roll along the supporting cables 5. Along the direction of travel A the system comprises a shoe 25, that is, a fixed structure along which the rollers 24 are separated from the supporting cables and travel on specific tracks 26 provided in said shoe. Said tracks 26 also form a seat for the supporting cables 5. As described previously, the supporting cable 20 at the shoe 25 is subject to relatively greater stress and so the supporting cable 20 must regularly be made to slide along the path of the system so that the shoe 25 regularly houses a new section of the supporting cable 20 that was previously outside the shoe 25.

Figure 2:
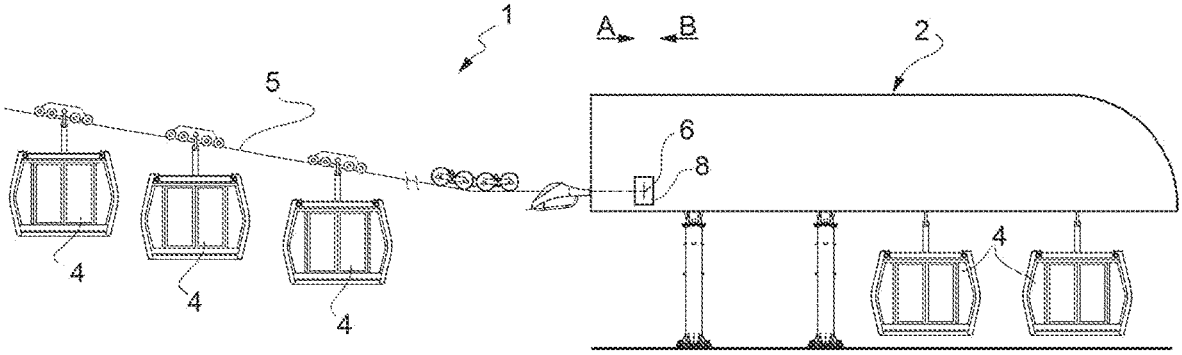
FIG. 2 is a schematic view of an end portion of the system of FIG. 1.

FIG. 2 shows a schematic view of an end portion of the system of FIG. 1, that is, the section of the system comprising a terminal station (upstream 2 or downstream 3) where the transporting units reverse the direction of travel from A to B (see the schematic arrows in FIG. 2). As schematically illustrated, the cabins 4 enter the station supported by the supporting cable 5. Inside the station, the cabins are no longer supported by the supporting cable 5 but by specific tracks (not illustrated). In this example, the supporting cable 5 comprises one end 6 anchored inside the station 2 by specific anchor devices (only schematically illustrated in FIG. 1 and denoted by reference numeral 8).

Figure 3:
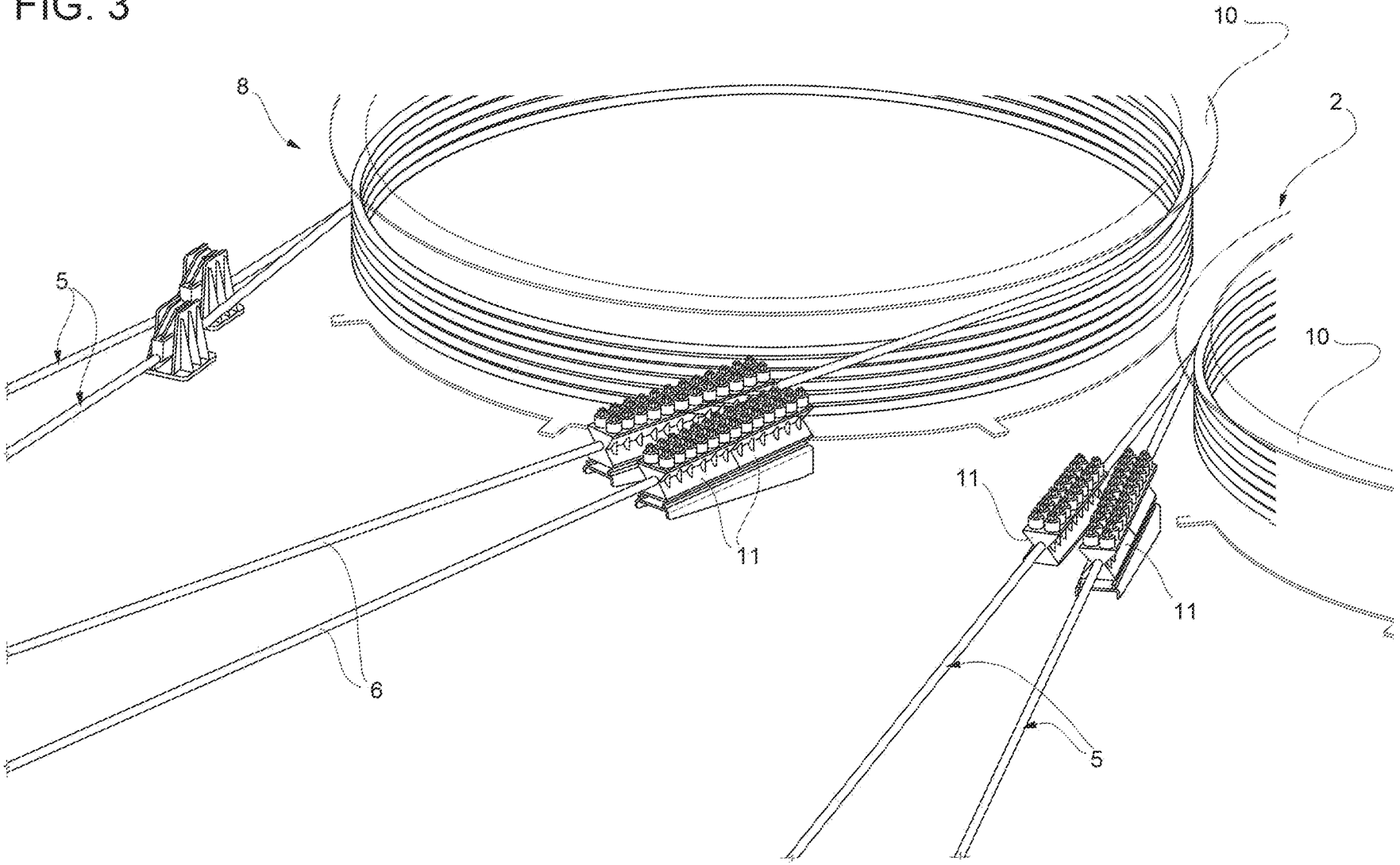
FIGS. 3 to 5 show schematic views of a first anchor device according to the present disclosure in different operating configurations.
Figure 4:
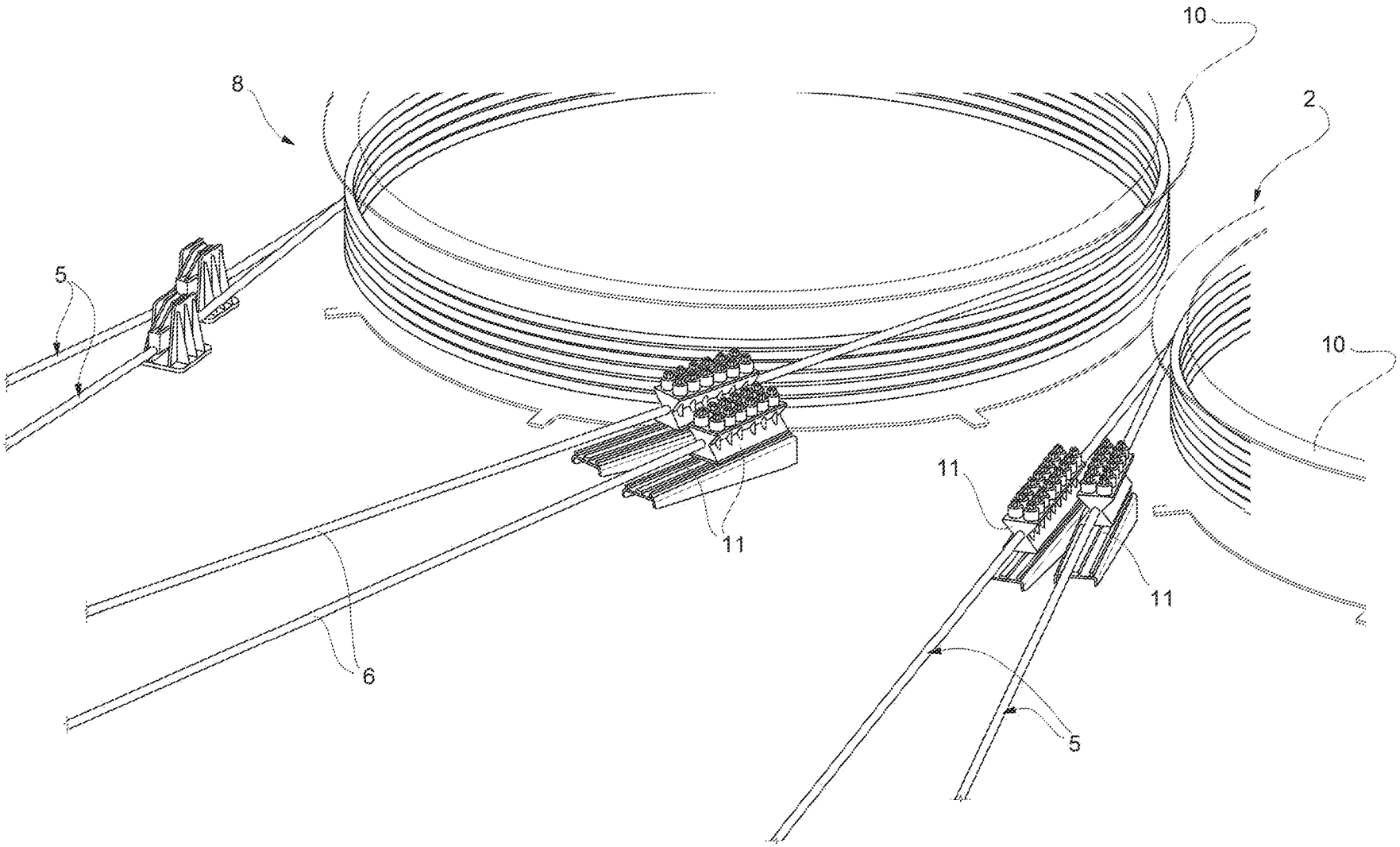
Figure 5:
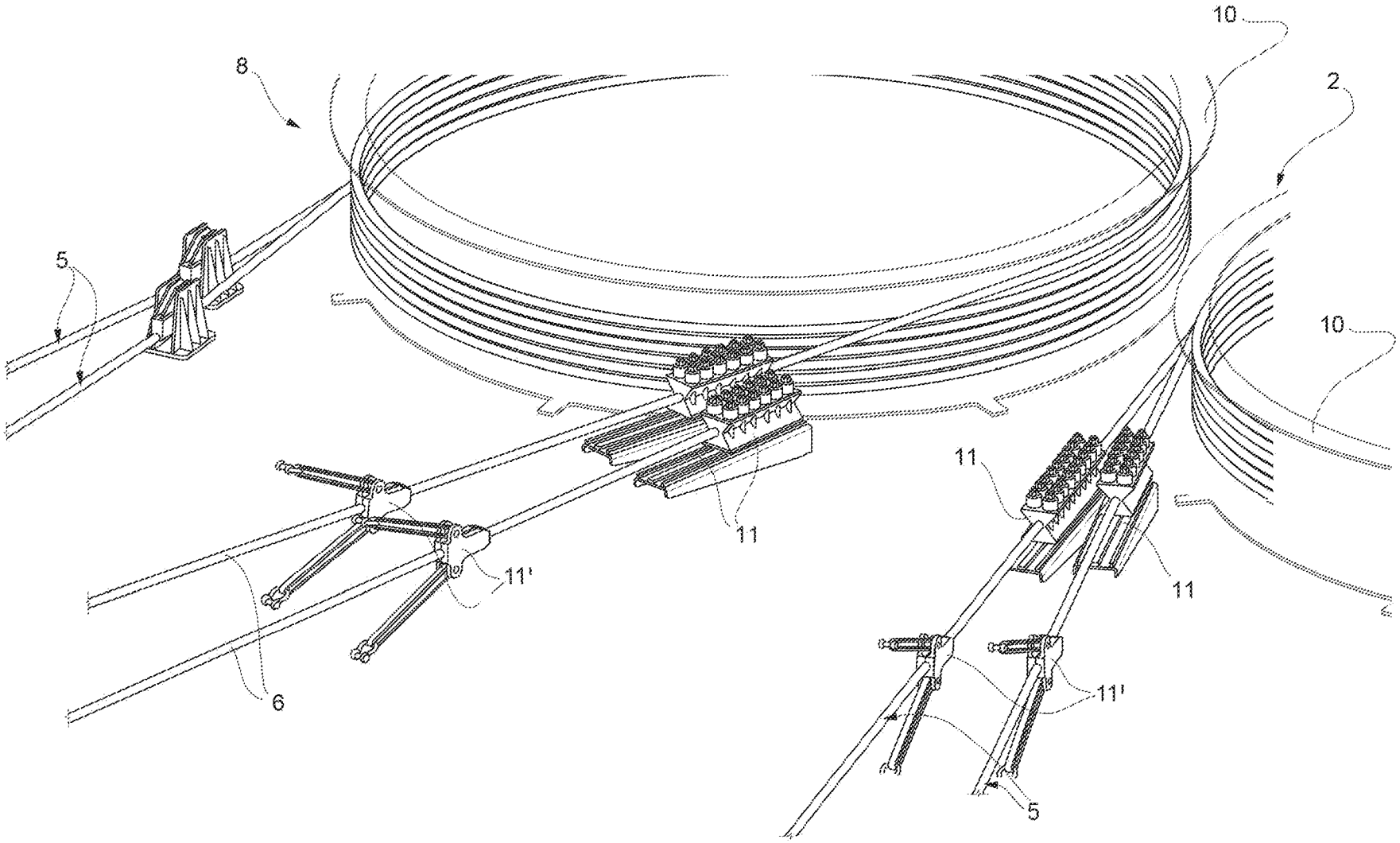

FIGS. 3 to 5 show schematic views of a first anchor device 8 according to the present disclosure in different operating configurations. Said first anchor device 8 is housed for example inside the upstream terminal station 2 and comprises, for each ascending and descending line, a winding drum 10 around which the ends of the two supporting cables 5 are wound. For the purposes of the present disclosure, the "end" of the cable does not necessarily refer to a short end section of the cable but to the entire length of cable inside the relative station. Thus, the word end refers to both the portion of cable wound around the winding drum 10 and the portion of cable that, downstream of the winding drum 10, is wound onto a spare drum, if present (not visible in FIGS. 3-5). The first anchor device 8 of FIGS. 3 to 5 further comprises a pair of fixed clamps 11 coupled to the ends 6 of the supporting cable 5 exiting the winding drum 10 towards the spare drum. The term "fixed clamps" refers to the fact that such clamps contrast with the fixed structure of the station to compensate the pull exerted by the cable. FIG. 4 shows a first step in the operations for sliding the supporting cables 5 along, in which the ends 6 of the cables have been at least partly freed by the clamps 11. In this example each clamp 11 comprises two clamp portions arranged in series and during the sliding step at least one of the pair of clamps 11 is opened or removed. Instead of said clamp, the present disclosure envisages the use of mobile clamps 11', that is, clamps capable of compensating any pulling force in the cables and at the same time of sliding the cable with respect to the fixed structure of the station 2 to follow the unwinding of the supporting cables from the spare drum and from the winding drum 10. Such mobile clamps 11' are schematically illustrated in FIG. 5 and can be permanently mounted on the system to reduce the total amount of time required to move the cables.

Figure 6:
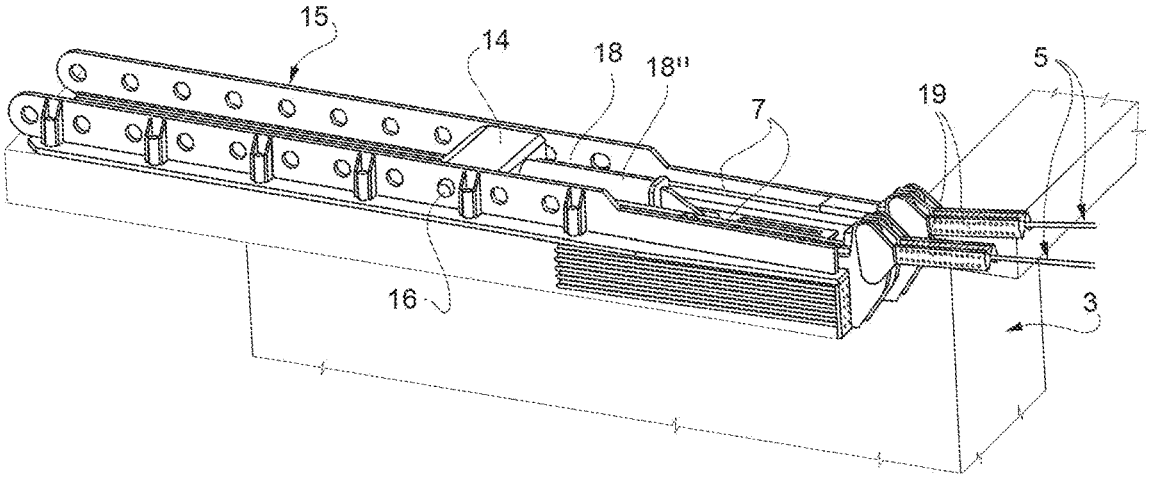
FIGS. 6 to 8 show schematic views of a second anchor device according to the present disclosure in different operating configurations.
Figure 7:
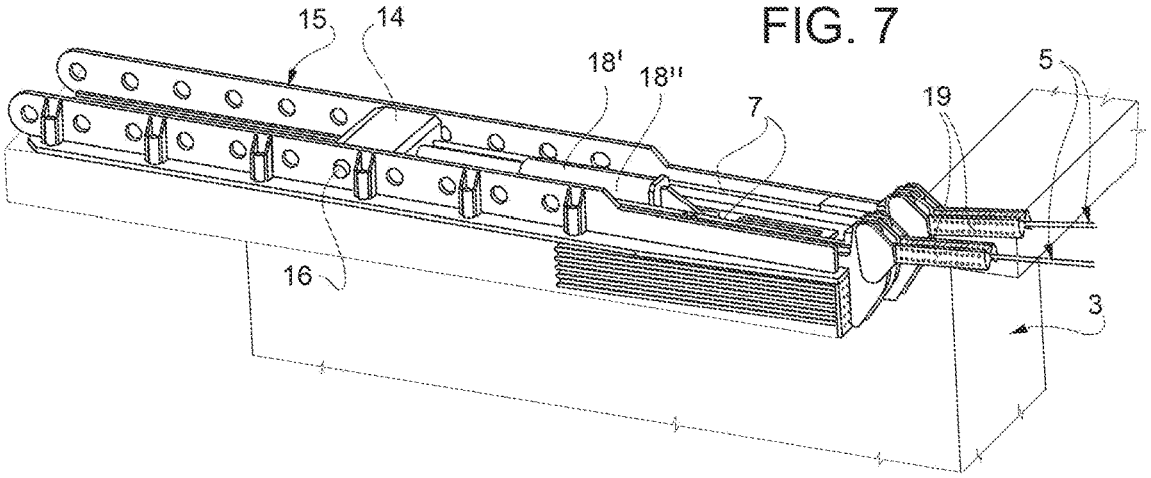
Figure 8:
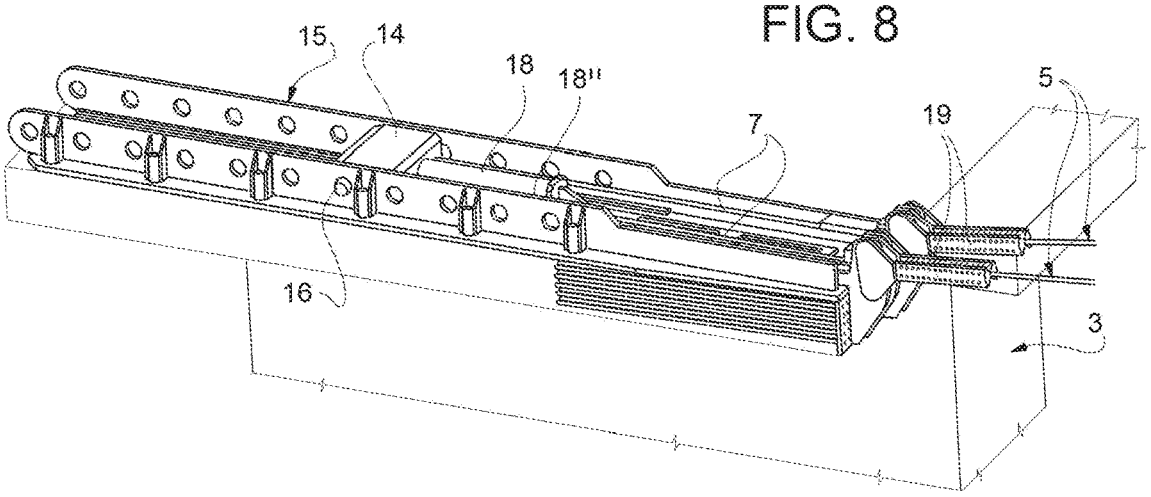

FIGS. 6 to 8 show schematic views of a second anchor device according to the present disclosure in different operating configurations. This example shows an anchor device for the ends of the supporting cables 5 housed inside the downstream station 3. According to this example, for each ascending and descending line, the second anchor device comprises a structure 14 inside which the two molten heads of the ends 6 of the two supporting cables 5 are anchored and a guiding device 15 along which the structure is able to slide 14. In the case of mono-cable systems, the structure 14 that slides along the guide 15 can consist directly of the molten head. In that sense, in the following description, reference numeral 14 will be used to indicate the "molten head". In the example in FIG. 6, the guiding device 15 is a track with a U-shaped cross section inside which the molten head 14 is housed. The side walls of the track comprise a sequence of holes configured to receive a pin 16 which is, in turn, coupled or can be coupled to the molten head 14. When the pin 16 is released from the relative holes, the molten head 14 can be made to slide along the track and then be fixed in the desired position. The pin may be operated manually or automatically (for example, hydraulically or pneumatically). As the molten head 14 slides along the track, the molten head causes the supporting cables to be unwound from the drums housed inside the opposite station and, thus, the entire cable is made to slide along the path. FIG. 7 shows the molten head 14 in a different position with respect to the position shown in FIG. 6. Such travel is generated in this example by a specific actuator device 18 comprising a hydraulic or pneumatic piston 18'. In the position in FIG. 7, the piston 18' has come out of the relative cylinder 18" to push the molten head 14 along the guide 15. When the new position for anchoring the molten head 14 along the guide has been reached, the cylinder 18" is also made to slide along the guide 15 in order to once again internally house the piston 18' (FIG. 8) and thus return to a configuration in which the piston is ready to push the molten head 14 along the guide 15 again. Auxiliary clamps 19 are shown upstream of the guiding device 15. Such clamps are activated when the molten head 14 reaches the last position in the guide. When this position is reached, the cable must be cut, a new molten head must be produced and re-arranged at the beginning of the guide to start a new sequence of stepped slides.

With reference to the example shown in the figures and with reference to the present disclosure in general, the supporting cables are moved along relatively quickly and relatively safely using equipment incorporated in the system inside the station for anchoring the supporting cables. Moreover, it should be appreciated that in accordance with the present disclosure, both supporting cables can be moved relatively safely at the same time.

Lastly, it is clear that modifications and variations may be made to the disclosure described herein without departing from the scope of the appended claims and without diminishing its intended technical scope. That is, various changes and modifications to the present embodiments described herein will be apparent to those skilled in the art and it is therefore intended that such changes and modifications be covered by the appended claims.

The invention is claimed as follows:

1. A cable transportation system comprising:

a first terminal station;

a second terminal station;

a transporting unit;

a supporting cable configured to support the transporting unit between the first terminal station and the second terminal station, wherein the supporting cable comprises a first end housed inside the first terminal station and a second end housed inside the second terminal station;

a first anchor device configured to anchor the first end of the supporting cable inside the first terminal station, the first anchor device configured to selectively block the first end of the supporting cable inside the first terminal station; and a second anchor device configured to anchor the second end of the supporting cable inside the second terminal station, the second anchor device configured to selectively block the second end of the supporting cable inside the second terminal station, wherein at least one of the first anchor and the second anchor is configured to enable a sliding of the supporting cable between the first terminal station and the second terminal station.

2. The cable transportation system of claim 1, wherein the first anchor device comprises a winding drum configured to wind the supporting cable and an upstream clamp coupled to the first end of the supporting cable exiting the winding drum.

3. The cable transportation system of claim 2, wherein the first anchor device comprises a spare drum downstream of the upstream clamp.

4. The cable transportation system of claim 2, wherein the first anchor device comprises a fixed clamp and a mobile clamp downstream of the fixed clamp.

5. The cable transportation system of claim 1, wherein the second anchor device comprises:

a blocking pin, a molten head configured to receive the second end of the supporting cable, the molten head defining a hole that receives the blocking pin, a guiding device configured to guide the molten head, the guiding device defining a plurality of through holes such that the molten head is configured to be anchored by the blocking pin to the guiding device in a plurality of positions.

6. The cable transportation system of claim 5, wherein the second anchor device comprises an actuator device configured to move the molten head along the guiding device.

7. The cable transportation system of claim 6, wherein the actuator device is one of a pneumatic actuator and a hydraulic actuator configured to move along the guiding device.

8. The cable transportation system of claim 5, wherein the second anchor device comprises an auxiliary clamp upstream of the guiding device.

9. The cable transportation system of claim 1, further comprising another supporting cable configured to support the transporting unit between the first terminal station and the second terminal station, wherein the other supporting cable comprises a first end housed inside the first terminal station and a second end housed inside the second terminal station.

10. The cable transportation system of claim 9, further comprising a hauling cable configured to move the transporting unit.

11. A cable transportation supporting cable anchoring system comprising:

a first anchor device configured to anchor a first end of a supporting cable inside a first terminal station, the first anchor device configured to selectively block the first end of the supporting cable inside the first terminal station; and a second anchor device configured to anchor a second end of the supporting cable inside a second terminal station, the second anchor device configured to selectively block the second end of the supporting cable inside the second terminal station, wherein at least one of the first anchor and the second anchor is configured to enable a sliding of the supporting cable between the first terminal station and the second terminal station.

12. The cable transportation supporting cable anchoring system of claim 11, wherein the first anchor device comprises a winding drum configured to wind the supporting cable and an upstream clamp coupled to the first end of the supporting cable exiting the winding drum.

13. The cable transportation supporting cable anchoring system of claim 12, wherein the first anchor device comprises a spare drum downstream of the upstream clamp.

14. The cable transportation supporting cable anchoring system of claim 12, wherein the first anchor device comprises a fixed clamp and a mobile clamp downstream of the fixed clamp.

15. The cable transportation supporting cable anchoring system of claim 11, wherein the second anchor device comprises:

a blocking pin, a molten head configured to receive the second end of the supporting cable, the molten head defining a hole that receives the blocking pin, a guiding device configured to guide the molten head, the guiding device defining a plurality of through holes such that the molten head is configured to be anchored by the blocking pin to the guiding device in a plurality of positions.

16. The cable transportation supporting cable anchoring system of claim 15, wherein the second anchor device comprises an actuator device configured to move the molten head along the guiding device.

17. The cable transportation supporting cable anchoring system of claim 16, wherein the actuator device is one of a pneumatic actuator and a hydraulic actuator configured to move along the guiding device.

18. The cable transportation supporting cable anchoring system of claim 15, wherein the second anchor device comprises an auxiliary clamp upstream of the guiding device.

* * * * *